US010724233B2

(12) United States Patent
Stahl, Jr. et al.

(10) Patent No.: US 10,724,233 B2
(45) Date of Patent: Jul. 28, 2020

(54) CURTAIN WALL SADDLE-BRACKET AND CLIP ASSEMBLY

(71) Applicant: Specified Technologies Inc., Somerville, NJ (US)

(72) Inventors: James P. Stahl, Jr., Princeton, NJ (US); Paul Gandolfo, Doylestown, PA (US); Julio Lopes, Dunellen, NJ (US)

(73) Assignee: SPECIFIED TECHNOLOGIES INC., Somerville, NJ (US)

( * ) Notice: Subject to any disclaimer, the term of this patent is extended or adjusted under 35 U.S.C. 154(b) by 0 days.

(21) Appl. No.: 16/438,164

(22) Filed: Jun. 11, 2019

(65) Prior Publication Data

US 2019/0292779 A1 Sep. 26, 2019

Related U.S. Application Data

(60) Division of application No. 15/874,663, filed on Jan. 18, 2018, now Pat. No. 10,329,762, which is a (Continued)

(51) Int. Cl.
*E04B 2/88* (2006.01)
*E04B 1/41* (2006.01)
(Continued)

(52) U.S. Cl.
CPC ..... *E04B 2/88* (2013.01); *E04B 1/40* (2013.01); *E04B 2/96* (2013.01); *E04B 2001/405* (2013.01)

(58) Field of Classification Search
CPC ..... E04B 1/40; E04B 2/88; E04B 2001/405; E04B 2/96; E04B 1/2403; E04B 2/825; E04B 2001/2415
See application file for complete search history.

(56) References Cited

U.S. PATENT DOCUMENTS

D242,766 S 12/1976 Neece
4,207,717 A 6/1980 Hubbard
(Continued)

FOREIGN PATENT DOCUMENTS

EP 0586320 A1 3/1994
KR 100996902 B1 11/2010
(Continued)

OTHER PUBLICATIONS

"Halfen HCW Curtain Wall Technical Product Information," Halfen, halfen.com, HCW-14.1 US, Oct. 2014.

*Primary Examiner* — Brian D Mattei
(74) *Attorney, Agent, or Firm* — Fox Rothschild LLP; Robert J. Sacco

(57) ABSTRACT

A bracket for securing insulation and/or a stiffener relative to a mullion or transom having a given width. The bracket includes a pair of legs extending from a bridge to define a receiving channel having a width equal to or smaller than the given width. The bracket can be attached to the mullion with friction. At least one of the legs defines a first receiving slot configured to receive a clip leg of a respective clip configured to engage the insulation, and an optional second receiving slot configured to receive a face of the stiffener. In an alternative configuration, the bracket can be attached to a side of the mullion via an existing anchor attachment near the floor line so that the anchor attachment does not interfere with the bracket.

15 Claims, 14 Drawing Sheets

Related U.S. Application Data continuation-in-part of application No. 15/818,271, filed on Nov. 20, 2017, now Pat. No. 10,329,761.

(60) Provisional application No. 62/424,772, filed on Nov. 21, 2016.

(51) Int. Cl.
*E04B 2/96* (2006.01)
*E04B 1/38* (2006.01)

(56) References Cited

U.S. PATENT DOCUMENTS

| | | | | |
|---|---|---|---|---|
| D294,914 | S | 3/1988 | Chase et al. | |
| 4,912,898 | A | 4/1990 | Holmes | |
| 4,918,879 | A | 4/1990 | Bodurow et al. | |
| 5,325,651 | A * | 7/1994 | Meyer | E04B 2/766 52/243 |
| 5,381,637 | A | 1/1995 | Farag | |
| 5,555,689 | A | 9/1996 | Gilmore | |
| 6,213,679 | B1 | 4/2001 | Frobosilo et al. | |
| 6,430,885 | B1 | 8/2002 | Ito | |
| 6,591,562 | B2 | 7/2003 | Ting | |
| 6,612,090 | B1 | 9/2003 | Corden | |
| 6,739,105 | B2 | 5/2004 | Fleming | |
| 6,951,087 | B2 | 10/2005 | Weurman | |
| 6,993,875 | B2 | 2/2006 | Rudduck | |
| 7,162,842 | B2 | 1/2007 | Ribic | |
| 7,854,099 | B2 | 12/2010 | Kidd | |
| 7,886,491 | B1 | 2/2011 | Shriver | |
| 8,033,066 | B2 | 10/2011 | Griffiths | |
| 8,443,556 | B2 | 5/2013 | Hiscock et al. | |
| 8,615,938 | B2 | 12/2013 | Arbour | |
| 9,016,014 | B2 | 4/2015 | Shriver | |
| D767,973 | S | 10/2016 | DeDios-Shirley et al. | |
| 9,683,367 | B1 | 6/2017 | Ting | |
| 10,364,566 | B1 * | 7/2019 | LeBlang | E04B 2/74 |
| 2002/0124514 | A1 | 9/2002 | Higgins | |
| 2003/0033765 | A1 | 2/2003 | Ting | |
| 2005/0056749 | A1 | 3/2005 | Simard | |
| 2005/0066613 | A1 | 3/2005 | Bourque | |
| 2006/0006296 | A1 | 1/2006 | Morita | |
| 2008/0229680 | A1 * | 9/2008 | Jahn | E04B 9/067 52/105 |
| 2010/0107532 | A1 | 5/2010 | Shriver | |
| 2012/0247059 | A1 * | 10/2012 | Daudet | E04B 1/2403 52/705 |
| 2014/0059973 | A1 | 3/2014 | Duranleau | |
| 2016/0237682 | A1 | 8/2016 | Stronks et al. | |
| 2017/0204600 | A1 | 7/2017 | Daudet et al. | |
| 2017/0342724 | A1 | 11/2017 | Farahmandpour | |
| 2018/0094423 | A1 | 4/2018 | Getz | |
| 2018/0142463 | A1 | 5/2018 | Siddhartha et al. | |
| 2018/0245352 | A1 | 8/2018 | Duranleau | |

FOREIGN PATENT DOCUMENTS

| | | | |
|---|---|---|---|
| KR | 101672855 | B1 | 11/2016 |
| KR | 20170017390 | A | 2/2017 |
| RU | 170635 | U1 | 5/2017 |

* cited by examiner

CURTAIN WALL SADDLE-BRACKET AND CLIP ASSEMBLY

RELATED APPLICATION

This application is a divisional application of and claims priority to non-provisional U.S. patent application Ser. No. 15/874,663 filed on Jan. 18, 2018 which is a continuation-in-part of, and claims priority to, U.S. patent application Ser. No. 15/818,271 filed on Nov. 20, 2017, which claims priority to U.S. Provisional Patent Application No. 62/424,772 filed Nov. 21, 2016. The disclosures of which are all incorporated herein by reference in full.

FIELD OF THE INVENTION

The present invention relates to a curtain wall insulation system, and in particular to a bracket and clip system for retaining wall insulation within the spandrel area of a curtain wall.

BACKGROUND OF THE INVENTION

Modern, multiple story buildings may be formed with an external wall structure that is secured to a floor slab. The external wall structure, or curtain wall, is secured to the slab, which is made of concrete, and the curtain wall is at a distance spaced away from the slab. By creating a gap between the slab and the curtain wall, proper alignment of the curtain wall is ensured. For example, in the event that the slab for a particular floor is not entirely straight or the slabs of adjacent floors are not properly aligned, the size of the gap between the curtain wall and a slab may be adjusted at various points along the slab to align the curtain wall so that it is substantially straight along the entire length and/or height of the building.

While the gap created between the curtain wall and the slabs of a building may be necessary to allow for proper alignment of the curtain wall, in the event of a fire, smoke, hot gasses, and/or flames, any of these conditions could pass from one floor to another through the gap between the curtain wall and the slabs. In order to prevent smoke, hot gasses, and/or fire from passing freely through this gap, safing insulation may be positioned between the slabs and spandrels of the curtain wall. Specifically, the spandrel areas of the curtain wall may be backed by a layer of spandrel insulation and the safing may be positioned between the spandrel insulation and the slabs in order to fill the gap between the spandrels and the slabs.

While systems of installing the spandrel insulation are known, such systems are often labor intensive, requiring screws, other additional fasteners, and/or are dangerous, requiring sharp pins or impaling spikes. For example, U.S. Pat. No. 7,886,491 to Shriver discloses an "Impasse" system used in today's curtain wall system using insulation hangers, which are steel base clips with a 12 GA steel pin swaged to the center. Such system requires screws to attach hangers and the insulation to be impaled onto the sharpened end, which is not always so easy to do in the field and may actually pose a safety risk to workers.

Still, most other systems require multiple screws and attachment points to be anywhere from 8 to 12 inches O.C. As the cost for installing each screw may be as high as $1.00 for the extra time and material it takes, the cost for installing these systems may add up quickly. Further, sometimes mullions also serve to allow for drainage, so driving screws in can create points that could later leak. Other times, mullions may incorporate some steel into the aluminum for strength, and pilot holes need to be drilled in there. Thus, it is desirable to reduce or eliminate screws in the installation of curtain wall insulation system.

This disclosure describes systems that address at least some of the technical issues discussed above, and/or other issues.

SUMMARY

In some embodiments, a curtain wall saddle bracket and clip assembly includes a bracket for securing insulation and/or a stiffener relative to a mullion or transom having a given width. The bracket includes a pair of legs extending from a bridge to define a receiving channel having a width equal to or smaller than the given width. At least one of the legs defines a first receiving slot configured to receive a clip leg of a respective clip configured to engage the insulation or configured to receive a face of the stiffener.

In some embodiments, the first slot is configured to receive a clip leg of a respective clip configured to engage the insulation and is defined by a slot plate supported in spaced relation to a surface of the leg. In at least one embodiment, the leg also defines a second receiving slot configured to receive a face of the stiffener.

In some embodiments, an insulation retaining system for a curtain wall includes a bracket and a clip. The bracket includes a pair of legs extending from a bridge to define a receiving channel having a width equal to or smaller than the given width. At least one of the legs defines a first receiving slot configured to receive a clip leg of a respective clip. The clip includes a pair of clip legs extending from a clip bridge with at least one of the clip legs including an inwardly extending projection configured to engage the slot plate once the clip leg has been extended through the first slot.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of various embodiments. In the drawings.

DETAILED DESCRIPTION OF THE INVENTION

Figure 1:
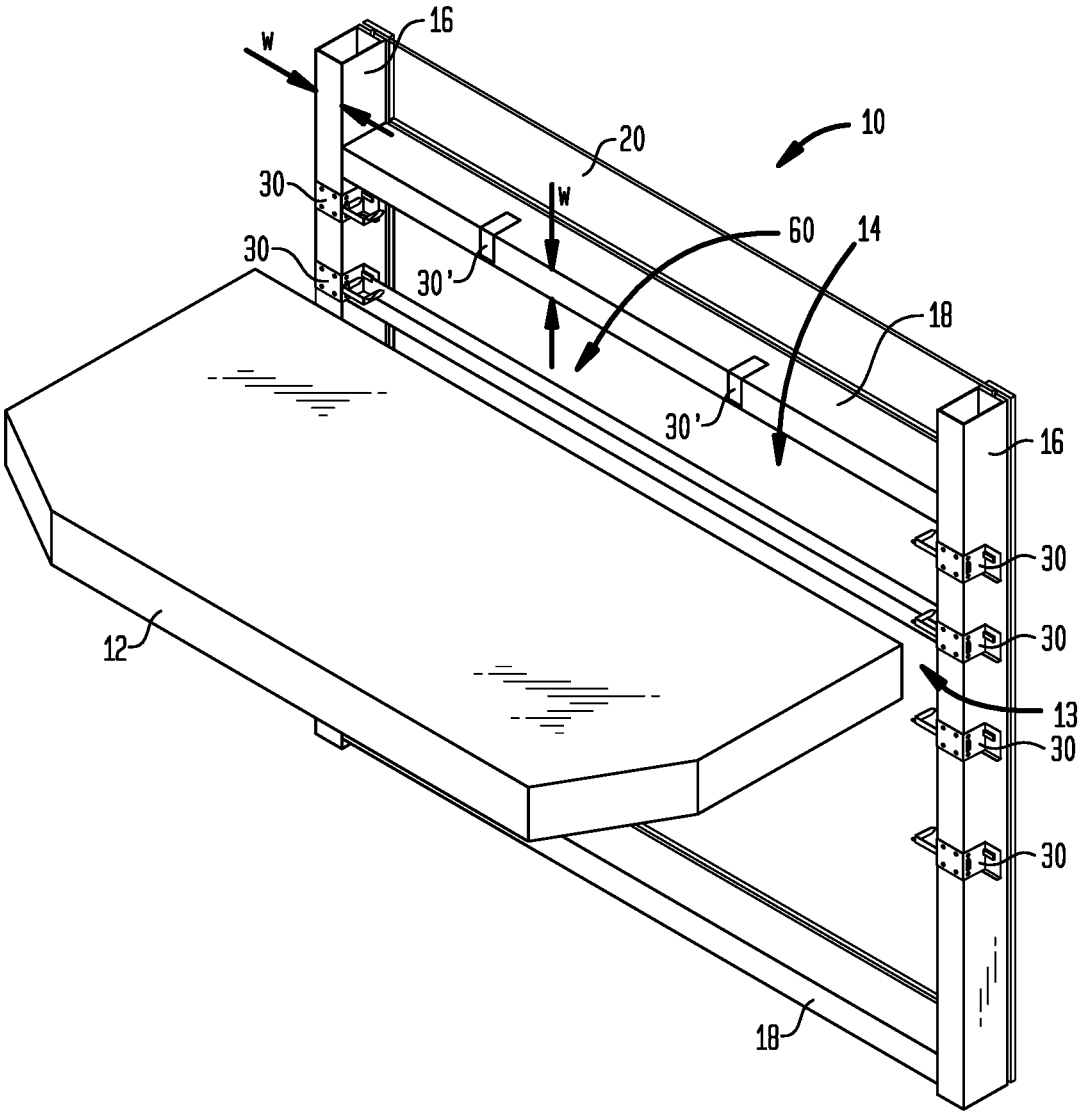
FIG. 1 is an isometric view of a wall system with mullions and transoms defining a spandrel area and brackets in accordance with some embodiments positioned on the mullions and transoms. The spandrel insulation is omitted from the figure for clarity.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
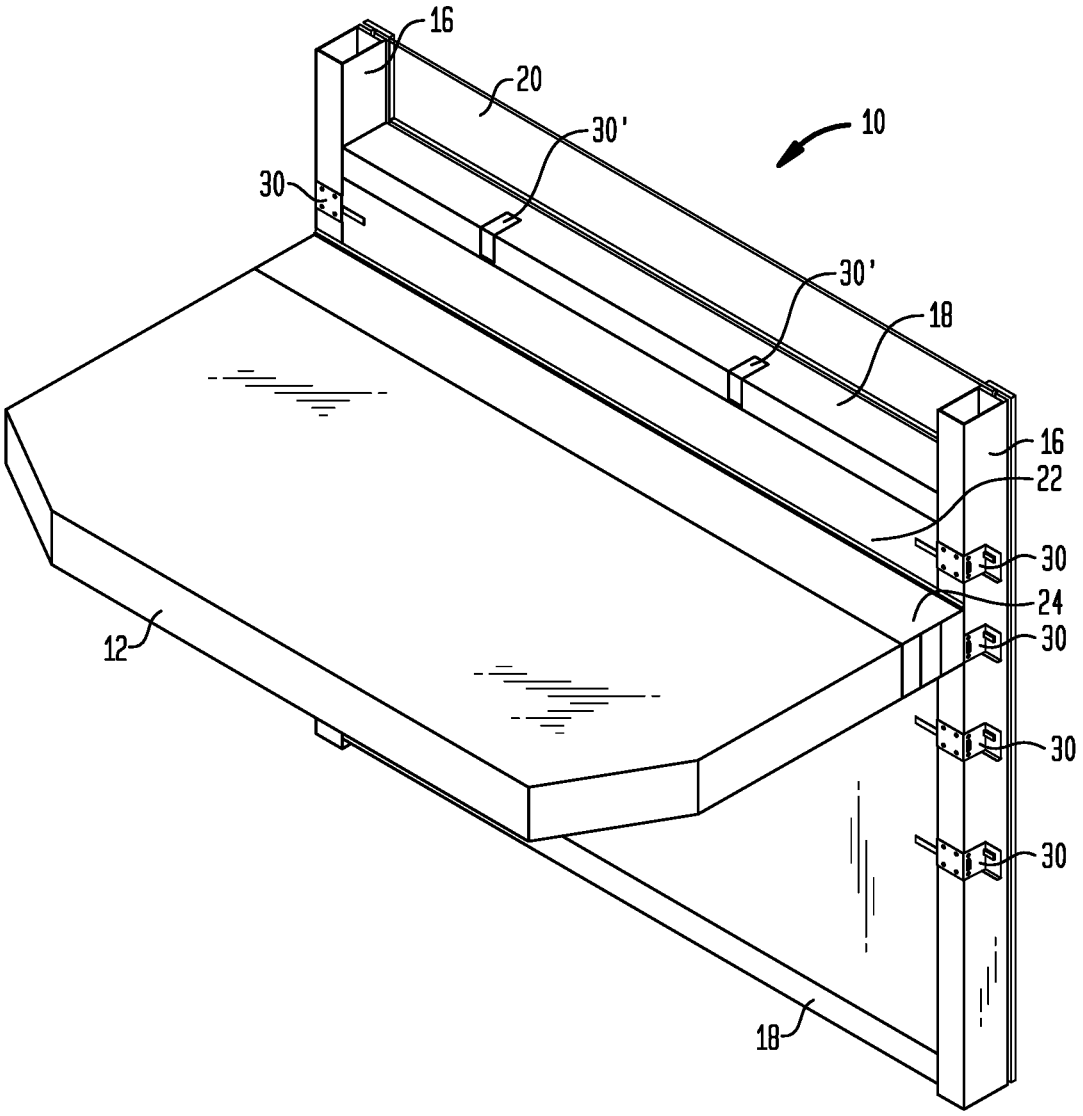
FIG. 2 is an isometric view similar to FIG. 1 with the spandrel insulation included.

Referring to FIGS. 1 and 2, an exterior wall system is depicted generally at numeral 10. The wall system 10 is connected to a slab 12, which forms one of the floors of a multi-floor building. The wall system 10 includes spandrel areas 14 which are covered by spandrels (not shown) that, in one example, define the exterior facade of the building. In some scenarios, spandrel areas 14 extend between the sill of a first vision glass installation and the head of a second vision glass installation. Spandrel area 14 is defined between mullions 16, which provide the vertical framework for wall system 10, and transoms 18, which provide the horizontal framework for wall system 10. Additionally, vision glass 20 may be positioned between portions of mullions 16 and transoms 18.

Referring to FIG. 2, main spandrel insulation 22 is positioned with the spandrel area 14. Spandrel insulation 22 is preferably a fire-retardant insulation that provides a first layer of fire protection for exterior wall system 10. As discussed above, wall system 10 is positioned at a distance spaced from slab 12 and secured thereto. As a result, gap 13 (in FIG. 1) is created between slab 12 and wall system 10. Thus, even though main spandrel insulation 22 is properly positioned, in the event of a fire, smoke, hot gasses, and/or flames any of these conditions may travel through gap 13 between slab 12 and wall system 10 and pass between adjacent floors of the building. In order to prevent and/or delay the passage of smoke, hot gasses, and/or fire between adjacent floors of a building, safing insulation is utilized.

As shown in FIGS. 1 and 2, safing insulation 24 is positioned between main spandrel insulation 22 and slab 12. Safing, as commonly used in construction industry, is made of noncombustible materials. It may be used as fire stop around the perimeter of a floor or around the protrusions or penetrations. In some embodiments, safing insulation 24 is mineral wool insulation. In order to increase the density of safing insulation 24 and, correspondingly, increase the ability of safing insulation 24 to delay and/or prevent the passage of smoke, hot gasses, and/or fire through gap 13 (in FIG. 1), safing insulation 24 is compressed between slab 12 and main spandrel insulation 22. Due to the compression of safing insulation 24, safing insulation 24 exerts a force on both slab 12 and main spandrel insulation 22. As a result of the force applied by safing insulation 24 to main spandrel insulation 22, main spandrel insulation 22 may be deformed. In order to prevent main spandrel insulation 22 from deforming due to the forces exerted by compressed safing insulation 24, support structure, such as stiffeners 60 (in FIG. 1) may be used. This support structure extends between opposing mullions 16 and provide a rigid area against which safing insulation 24 may press. For example, stiffeners 60 are sufficiently strong to resist deformation due to the forces exerted by compressed safing insulation 24. Thus, by utilizing support structure, such as stiffeners or other mechanical backer bars, such as metal angles or hat channel, deformation of main spandrel insulation 22 is substantially or entirely prevented.

Figure 3:
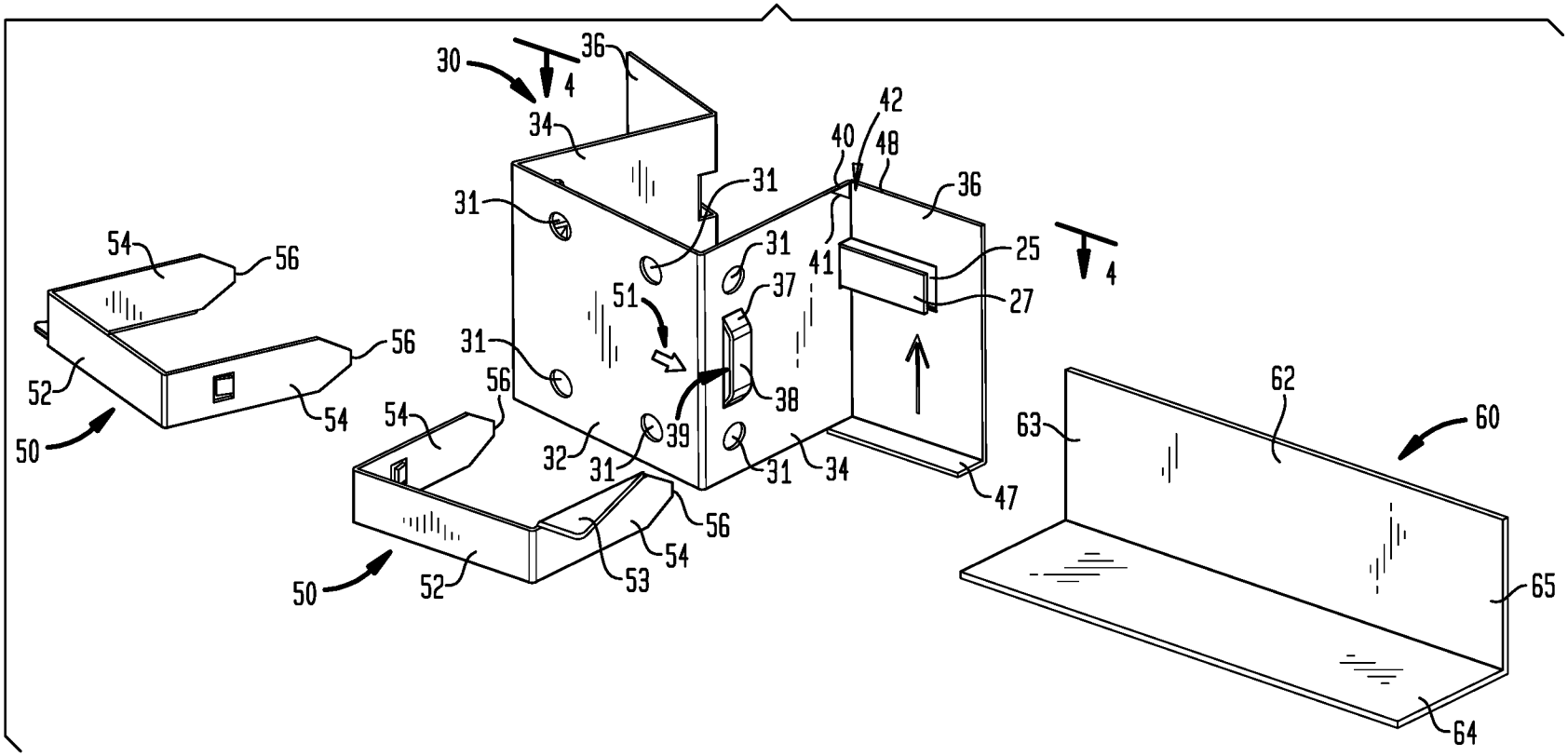
FIG. 3 is an isometric view of an example of a bracket and clips, and a stiffener in some embodiments.

In FIG. 3, in some embodiments, bracket 30 and clip 50 system configured to facilitate installation of the stiffeners 60 and the spandrel insulation are described. An example of a bracket 30 includes a bridge 32 extending between a pair of legs 34. Each leg 34 includes an outwardly extending flange 36 configured to engage and support the rear surface of the spandrel insulation 22, as will be described hereinafter.

Figure 4:
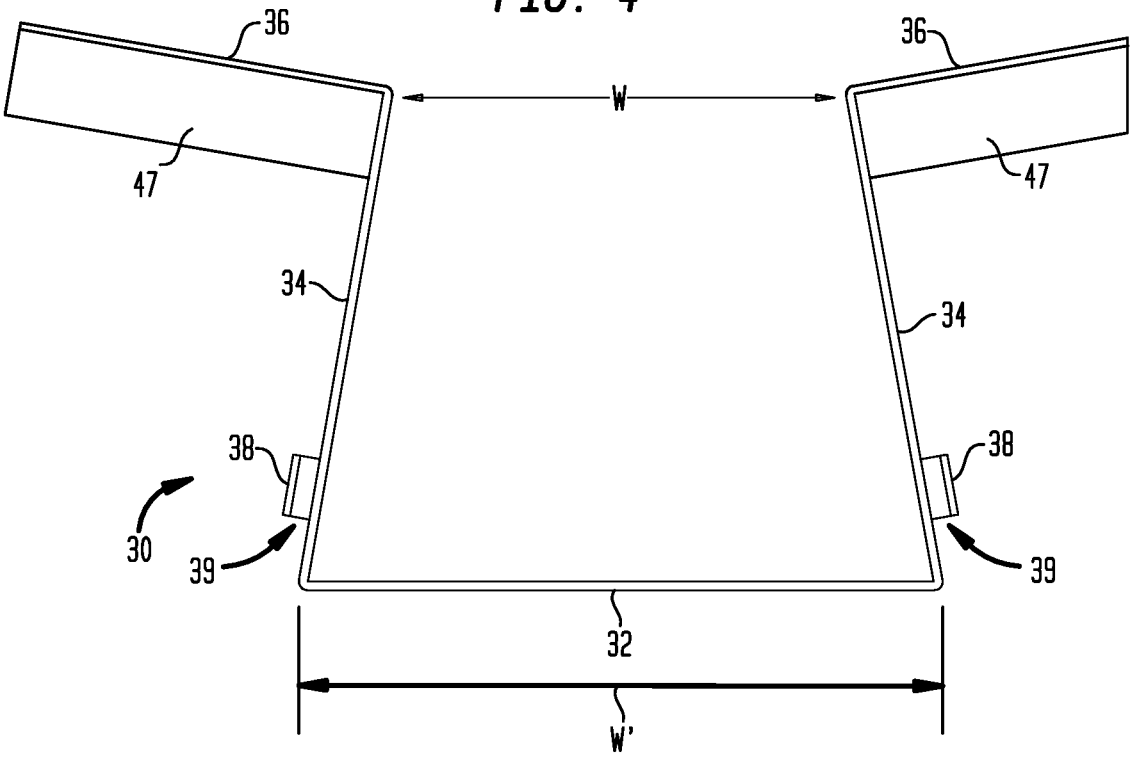
FIG. 4 is a cross-sectional view of the bracket along the lines 4-4 in FIG. 3.

In FIG. 4, legs 34 of bracket 30 are each about at a 90° angle with respect to bridge 32, although the angle can be more or less than 90°. An open channel 33 is defined between legs 34 having a width W which is approximately the same or slightly smaller than the width w of the mullions 16 or transoms 18 (see FIG. 1). Bridge 32 has a width W' that is not smaller than the width w of the mullions. With such configuration, bracket 30 is configured to receive either a mullion 16 or transom 18 into channel 33 with a friction fit. In this manner, bracket 30 may be installed onto mullion 16 or transom 18 by simple forcing thereon, for example, with a rubber mallet, and without the need for any fasteners or the like.

Returning to FIG. 3, alternatively, and/or additionally, bracket 30 may include one or more screw holes 31 on bridge 32 or on any of leg 34, the one or more screw holes 31 allow the bracket to be fixedly attached to the mullion or transom by screw. The screw may be used on either bridge 32 or leg 34 where permitted per the structure of the mullion or transom. In some embodiments, to assist in retaining spandrel insulation 22 (in FIG. 2), each leg 34 includes a first receiving slot 39 defined between a slot plate 38 and leg 34. Slot plate 38 is supported by slot side walls 37 which extend between leg 34 and slot plate 38. Slot plate 38 and slot side walls 37 may be formed through a stamping process or otherwise formed.

Each receiving slot 39 is configured to receive a clip leg 54 of a respective clip 50. Each clip 50 includes a clip bridge 52 extending between a pair of clip legs 54 such that clip 50 has a substantially U-shape. The free end 56 of each clip leg 54 has a tapered configuration. The tapered free end 56 facilitates passage into the receiving slot 39 or provides a sharpened tip for penetrating the spandrel insulation 22, as will be described hereinafter.

Figure 5:
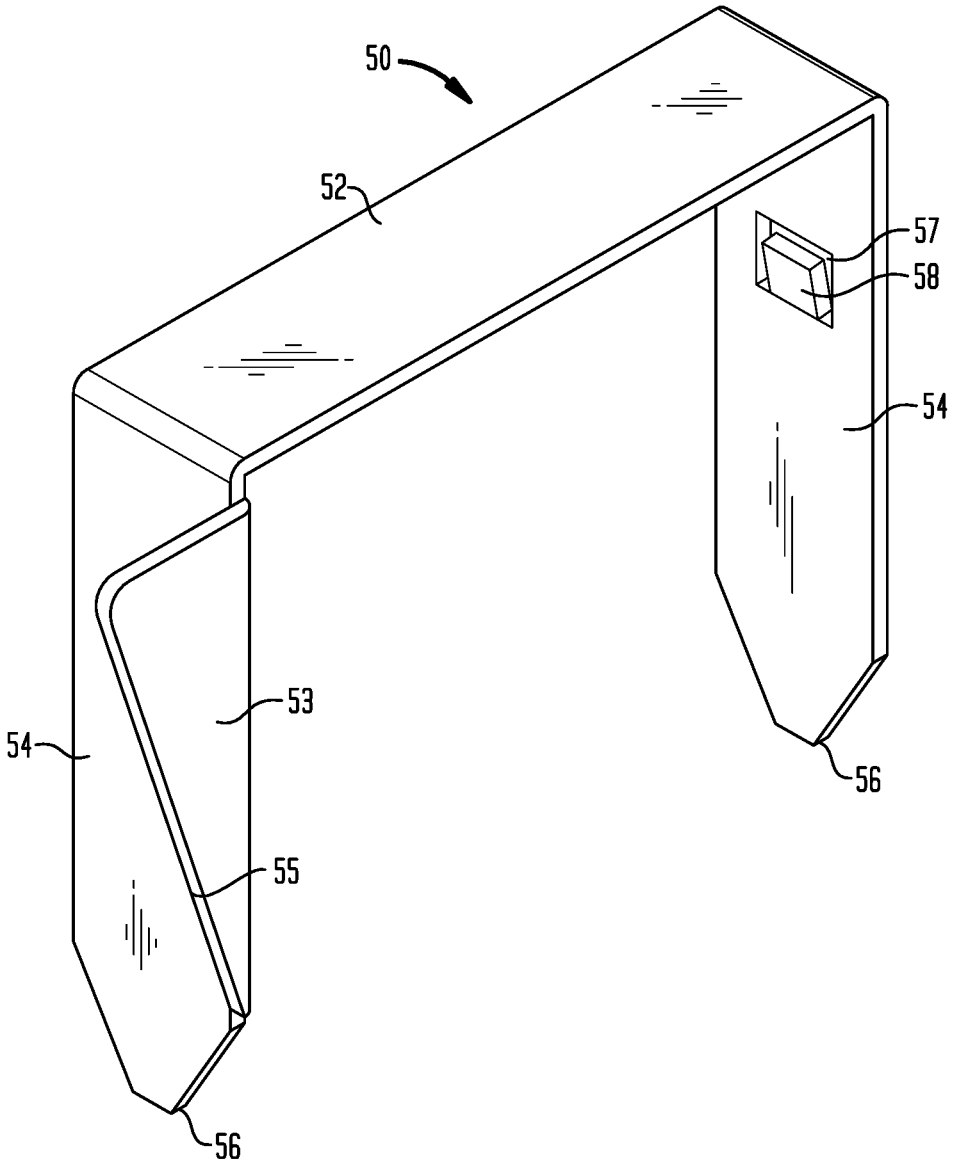
FIG. 5 is an isometric view of an example of a clip in some embodiments.

In FIG. 5, in some embodiments, at least one of the pair of clip legs 54 has a wing 53 that extends at a right angle from the surface of clip leg 54. Wing 53 has an outer edge 55 that is wedged from a portion distal from free end 56 towards free end 56 of the clip leg 54. When one of the pair of clip legs 54 is engaged into receiving slot 39 of the bracket 30 (FIG. 3), wing 55 on the other leg is inserted into the spandrel insulation. This helps retain the spandrel insulation in the spandrel space and also prevent the spandrel insulation from moving longitudinally (or up and down) along the mullion.

Figure 9:
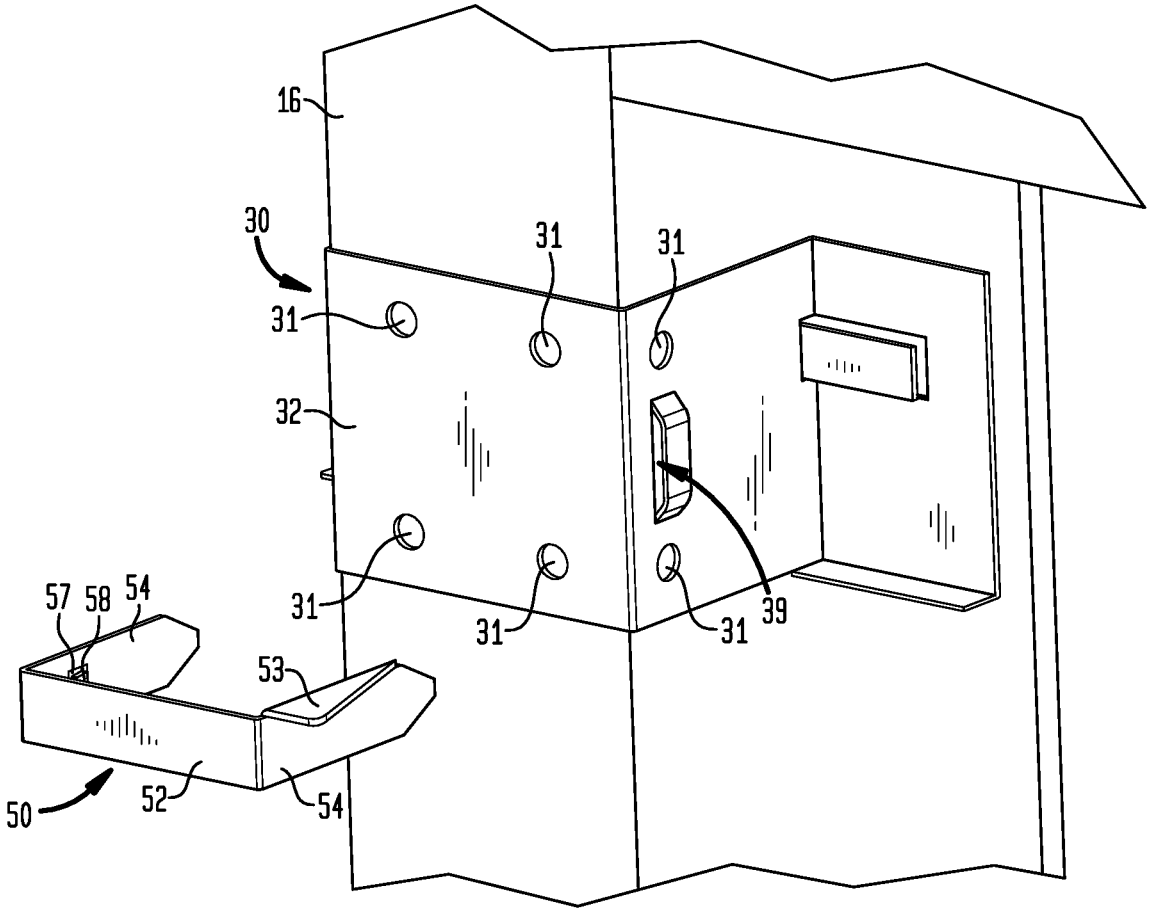
Figure 10:
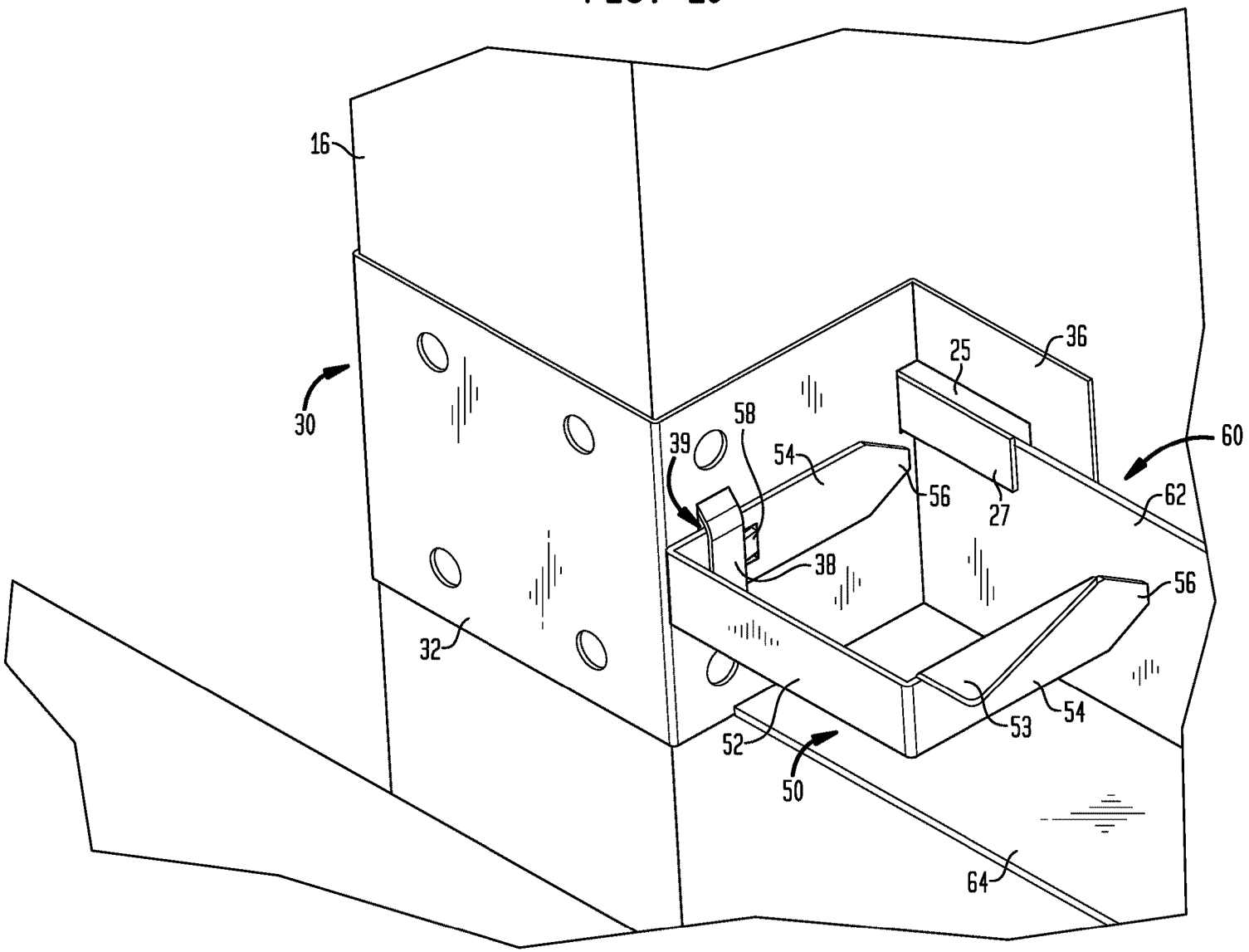

In some embodiments, each clip leg 54 defines an inwardly extending projection 58 extending from notch 57 defined in clip leg 54. As shown in FIGS. 9 and 10, as clip leg 54 is passed through a respective bracket receiving slot 39, the inwardly extending projection 58 biases into notch 57 as it passes slot plate 38 and once fully inserted, returns to the natural inwardly extending position such that projection 58 engages slot plate 38 and maintains clip 50 engaged with bracket 30.

Figure 6:
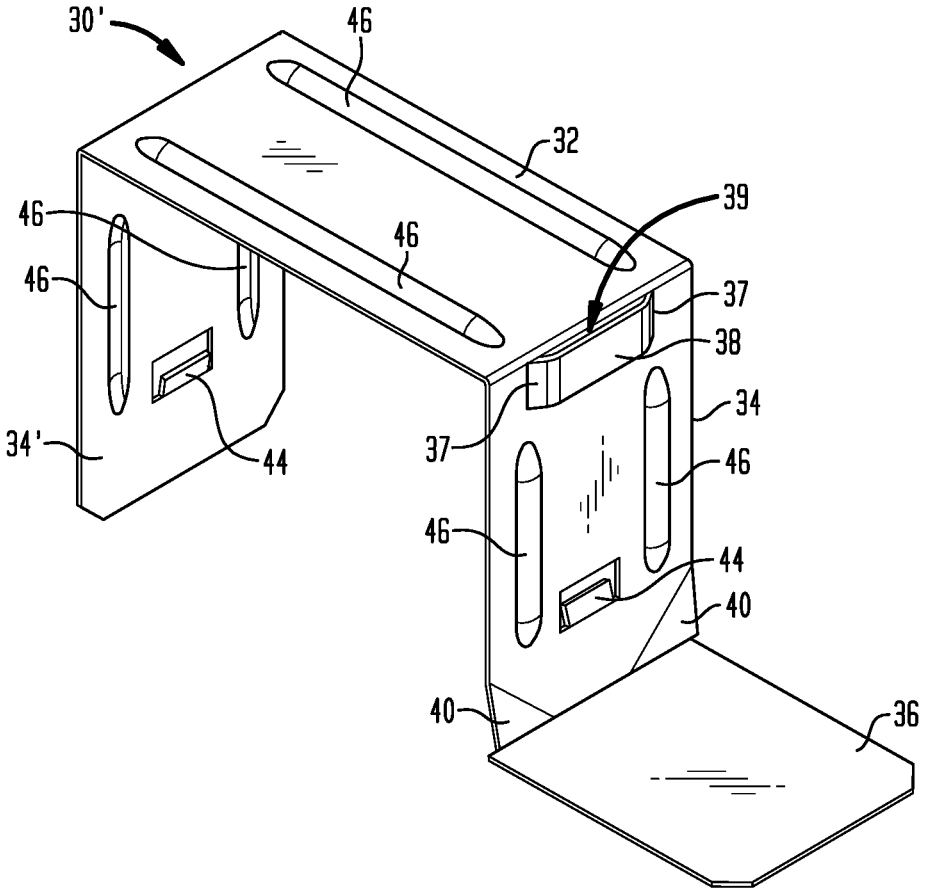
FIG. 6 is an isometric view of an example of a bracket in some embodiments.

FIG. 6 illustrates an alternative bracket 30', for which one of the legs 34' may be free of the flange. For example, when bracket 30' is to be used along transom 18 (FIG. 1) or along a corner mullion 16 (FIG. 1) which has a spandrel area on only one side of the mullion, the flange is not extending in front of vision glass 20 (FIG. 1). Bracket 30' illustrated in FIG. 6 also illustrates other optional features including an inwardly extending projection 44 on each leg 34 to assist in securing the bracket. For example, extending projection 44 may be positioned to contact the mullion or transom and help to further retain the bracket in position. Bracket 30' also may include reinforcing ribs 46. In other regards, bracket 30' functions in the same manner as bracket 30 to be described hereinafter. Alternatively, and/or additionally, bracket 30 also may include the inwardly extending projections 44 on legs 34 and/or reinforcing ribs 46.

Figure 7:
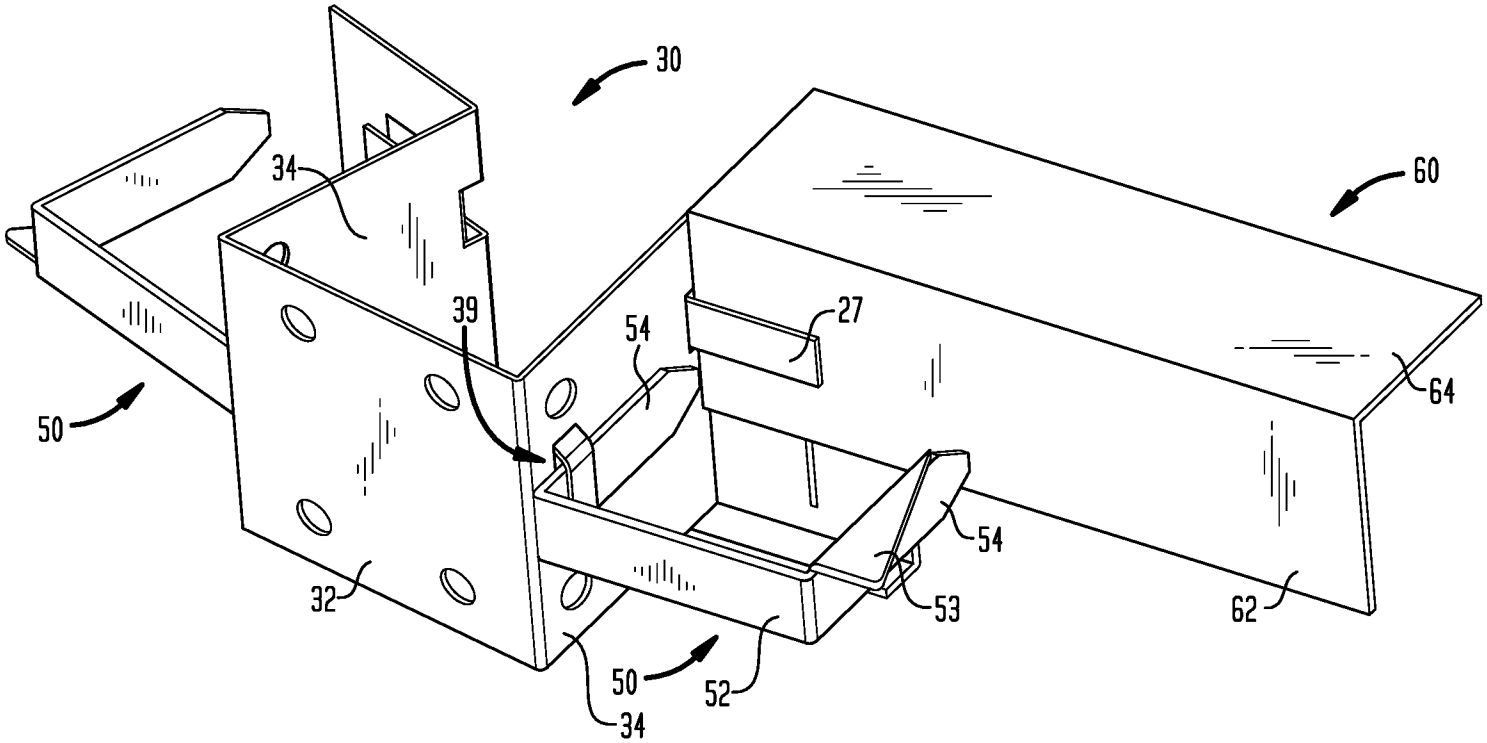
FIG. 7 is an isometric view illustrating a pair of clips and a stiffener engaged with the bracket of FIG. 3.
Figure 8:
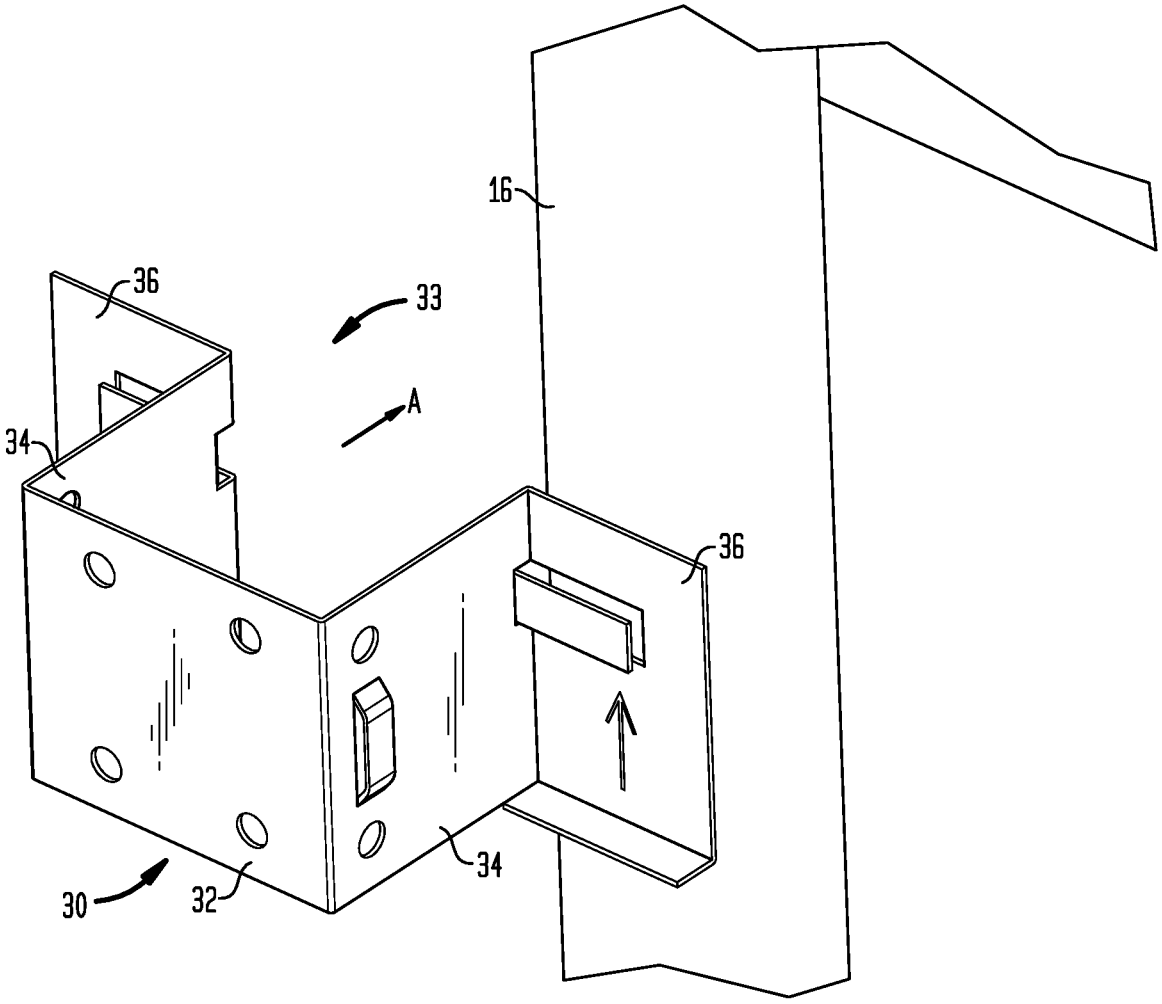
FIGS. 8-14 are isometric views illustrating installation of brackets and clips relative to spandrel insulation and positioning of stiffener in some embodiments.

Referring to FIGS. 3 and 6, brackets 30, 30' are also configured to support stiffeners 60 between two opposing mullions 16 (FIG. 1). Each leg of bracket 30 may further include a second receiving slot 25 along the surface of flange 36. In some embodiments, receiving slot 25 may be formed by a cut plate 27 that is a portion of the flange 36 that is cut and raised from the surface of flange 36 to be at a distance therefrom, such that receiving slot 25 allows receiving a face plate of stiffener 60. Once the face plate of the stiffener is received by receiving slot 25, it is retained in place by cut plate 27. FIG. 7 shows a stiffener that is received in the receiving slot behind cut plate 27.

Returning to FIG. 3, flange 36 may have an additional flange 47 extending from flange 36 at the bottom outwardly towards bridge 32 of the bracket. The additional flange 47 serves as a support for the stiffener. An embodiment of stiffener 60 as shown in FIG. 3 is an L-shaped angle bar that has a vertical face plate 62 and a horizontal face plate 64. An end portion 63 of vertical face plate 62 of stiffener 60 may be received into receiving slot 25 of a first bracket 30 that is attached to a mullion, whereas horizontal face plate 64 is positioned to stay atop flange 47 of bracket 30. A second bracket (not shown) can be attached to an opposing mullion and can be used to receive an opposing end 65 of vertical side 62 of stiffener 60 and also support the stiffener.

To install the angle bar as shown in FIG. 3 between two opposing brackets, the stiffener may be installed from the bottom, in that vertical face plate 62 of the stiffener may first be slid upwardly at an angle from the bottom into receiving slots 25 of two opposing brackets, then tilted straight up while being slid into receiving slots 25 until horizontal face plate 64 of the stiffener passes above bottom flange 47 of the bracket. Then the stiffener may be dropped so that its horizontal face plate 64 rests on top of bottom flange 47, while vertical side 62 is maintained in position in receiving slots 25 of opposing two brackets.

Bottom face plate 64 of the L-shaped angle bar provides support to the upper mineral wool panel that fills in the spandrel panel area. The stiffener also acts as a stiffener to reinforce the area at the edge of slab. Once installed, the stiffener maintains compression on the mineral wool safing insulation, but they also keep the over-compressed mineral wool safing sections from damaging the rigid curtain wall insulation.

With reference to FIG. 7, an alternative configuration of stiffener 60 is illustrated. In FIG. 7, the stiffener is a hat channel that is rotated relative to its position in FIG. 3 in that vertical face plate 62 becomes a front face and horizontal face plate 64 extends from vertical face plate 62 towards the rear face of the spandrel insulation away from bridge 32 of bracket 30. The L-shaped angle bar can be installed onto two opposing brackets 30 by directly sliding vertical face plate 62 into the receiving slots behind cut plates 27 of the two brackets from the top until horizontal face plate 64 rests on the top edge 48 of flange 36 (FIG. 3). In such configuration, the curtain wall insulation can be placed inside the spandrel space, without split, past the stiffener and the floor slab.

With reference to FIG. 3, optionally, adjacent to the junction of each leg 34 and flange 36, corner tabs 40 are bent outwardly along line 41 such that a corner receiving slot 42 is defined between each corner tab 40 and flange 36. The corner receiving slot 42 has a width approximately equal to a thickness of vertical face plate 62 of stiffener 60. In the illustrated embodiment, stiffener 60 is a hat channel as shown in the configuration in FIG. 7. Each end of vertical face plate 62 is received in corner receiving slots 42 of a pair of brackets 30 positioned on adjacent mullions 16 (see FIG. 1) such that stiffener 60 is supported therebetween, with the respective flanges 36 extending behind vertical face plate 62 and preventing movement of stiffener 60 away from safing insulation 22 (FIG. 2). Corner tab 40 serves two purposes. It helps to hold the L-shaped angle that will be used as a stiffener at the floor line. It also gives the bracket some rigidity and strength.

Referring to FIGS. 1, 2 and 8-10, an example of a process for installing the spandrel insulation is described. The process may include: attaching a plurality of spaced-apart brackets, each bracket having a first receiving slot; positioning the insulation in a space adjacent to the mullions and/or transoms; and engaging with each bracket a clip having a pair of clip legs with a first of the pair of clip legs extending through the first receiving slot of the bracket and a second of the pair of clip legs penetrating into the insulation, wherein the other clip leg has a tapered free end. The bracket can have various configurations. For example, using the bracket 30, 30' (in FIGS. 3 and 6), the process may include attaching a plurality of spaced-apart brackets 30, 30' to mullions 16 and transoms 18 (FIG. 1), either by friction fit or by screw or bolt or by other methods. In friction fit, each bracket 30, 30' is positioned by aligning open channel 33 with mullion 16 or transom 18 and forcing bracket 30, 30' as indicated by arrow A in FIG. 8 into friction fit on mullion 16 or transom 18. With brackets 30, 30' so positioned, the process may further position spandrel insulation 22 in spandrel space 14 with the rear surface thereof supported by flanges 36. Thereafter, the process may engage a clip 50 with each bracket 30, 30', with one of clip legs 54 extending through a respective receiving slot 39 and the other clip leg 54 penetrating into spandrel insulation 22.

As shown in FIG. 3, bridge 32 of bracket 30 may have a mark 51 on the outside surface of the bridge to show the location of receiving slot 39, which is already covered by spandrel insulation 22. This allows easy installation of clip 50 after the leg of the bracket is covered by the spandrel insulation. Once each clip is engaged with the bracket, projection 58 of each clip leg 54 engages respective slot plate 38 such that clips 50, and thereby the spandrel insulation 22. is retained by brackets 30, 30' and clips 50.

Optionally, before positioning the insulation in the space adjacent to the mullion or transom, the process may include: attaching two opposing brackets onto two opposing mullions, respectively; and installing a stiffener onto the two opposing brackets by sliding a vertical face plate of the stiffener into a second receiving slot of each of the two opposing brackets. The second receiving slot for each bracket may be formed by a portion of the flange that is cut and raised from a surface of the flange of each respective opposing bracket.

With reference to FIG. 3, an example of the above process may include attaching two opposing brackets 30 on two opposing mullions proximate to the floor slab and installing stiffener 60 onto two opposing brackets 30. In some embodiments, the stiffener may be an L-shaped angle bar as shown in FIG. 10, and the process may include sliding vertical face plate 62 of the angled bar at an angle upwardly into receiving slots 25 of each bracket 30 from the bottom, tilting vertical face plate 62 while being slid upwardly until horizontal face plate 64 of angled bar 60 passes above the bottom flange (47 in FIG. 3), and dropping the stiffener to allow it to sit on top of bottom flange 47. Once stiffener 60 is installed, the process of positioning spandrel insulation 22 may include positioning a split panel of the spandrel insulation into the top of the bottom flange (47 in FIG. 3). Alternatively, stiffener 60 is a hat channel, and the process may include sliding the vertical face plate of the hat channel to receiving slots 25 of each bracket 30 from the top until the horizontal face plate of the hat channel rests on the top edge 48 of flange 36 (FIG. 3).

In above various illustrated embodiments, bracket 30, 30', clip 50, and stiffener 60 (FIG. 3) can be made of steel or other metal. Bracket 30, 30' also may be made of elastic materials to allow for friction fit on the mullion or transom. Other materials may be used as appreciated by one of ordinary skill in the art.

Figure 11:
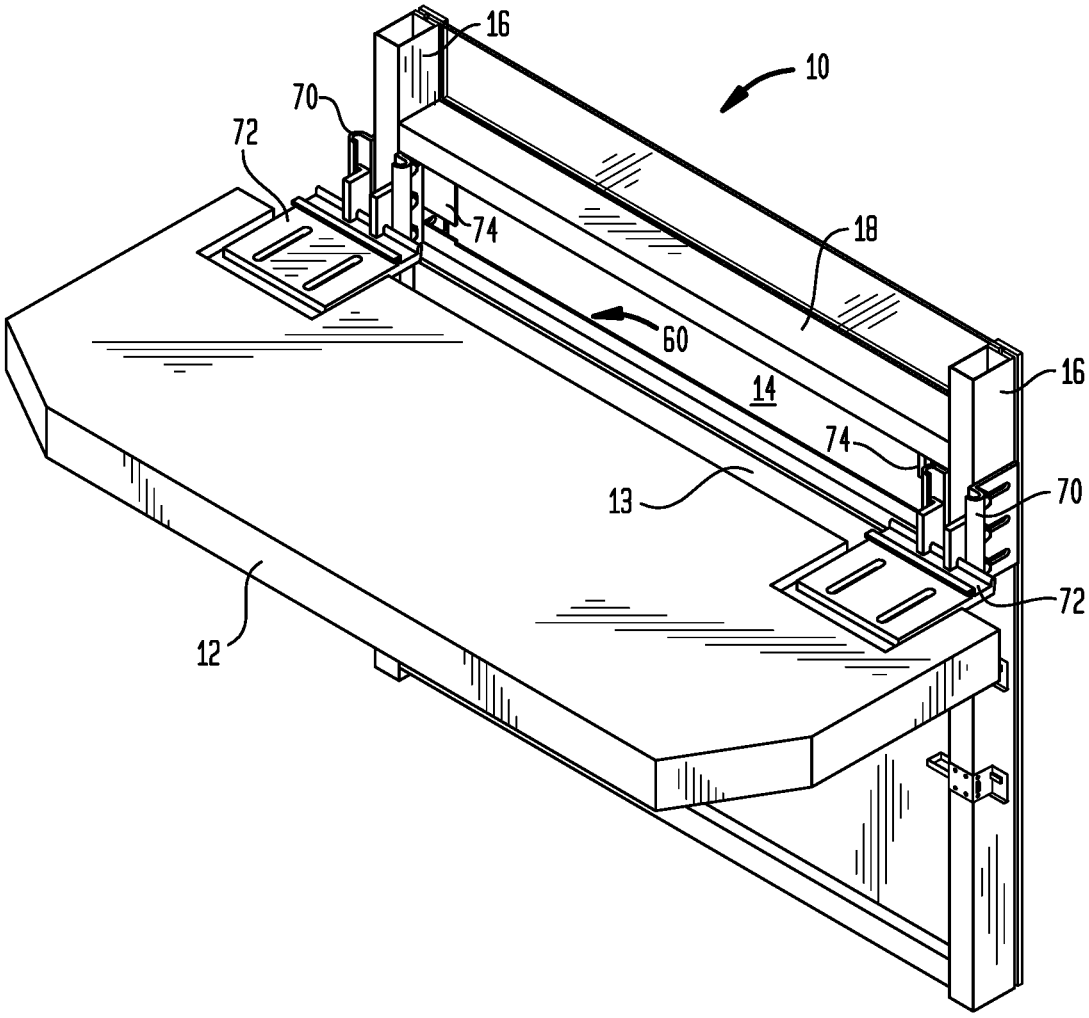

With reference to FIG. 11, the bracket may vary to accommodate different structures in the building in which the curtain wall insulation is installed. For example, a floor slab 12 may be attached to a mullion 16 by an anchor attachment 70, 72. This may interfere with the bracket (30 in FIG. 1) near the floor line.

Figure 12:
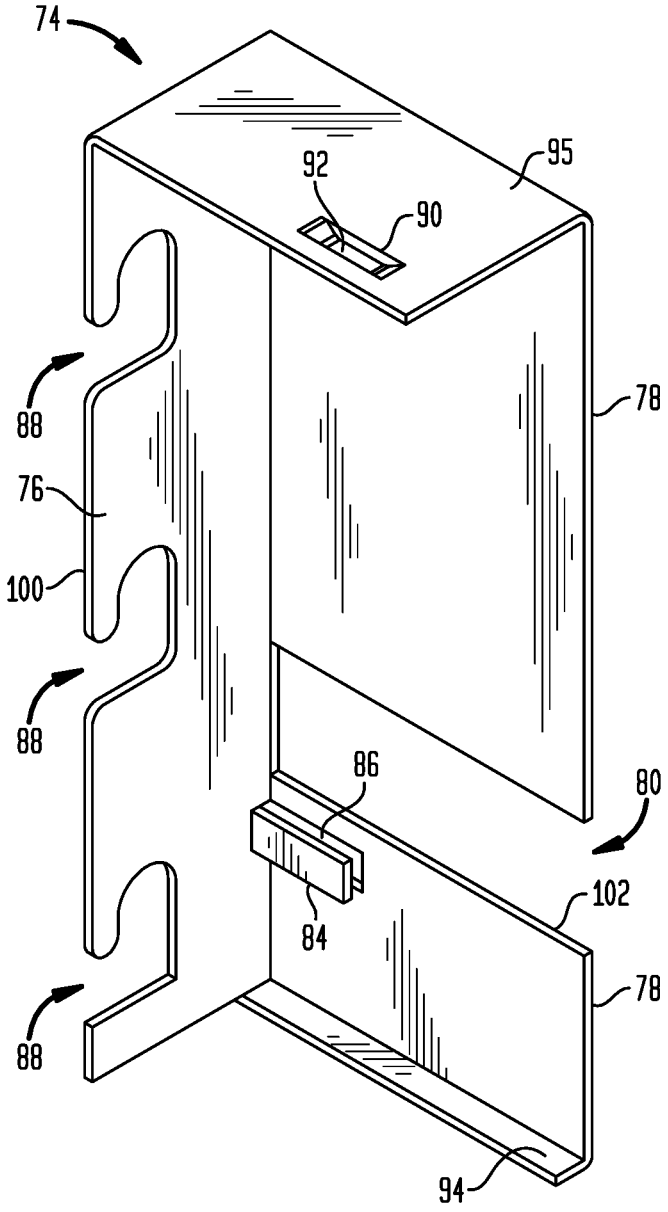

In FIG. 12, in some embodiments, a bracket 74 may include a side plate 76 defining at least one aperture 88 positioned to engage with a fastener for attaching the side plate 76 to a side surface of the mullion, which will be described in detail later in this document. Bracket 74 may also include a back plate 78 extending perpendicularly from the side plate 76 and defining a first receiving slot 86 formed by a portion 84 of the back plate 78 that is cut and raised from a surface of the back plate, wherein the first receiving slot 86 is configured to receive a face plate of a stiffener, which will be explained later.

The back plate 78 may include a flange 94 extending outwardly from the bottom of the back plate 78 towards a front edge of the side plate 100. Back plate 78 may also have a top edge 102 near the first receiving slot 86. Aperture 88 in the side plate 76 may also include an opening through the front edge 100 of the side plate 76 to allow the side plate 76 to slide into an anchor attachment to the mullion so that the aperture in the side plate engages with a fastener of the anchor attachment. This is further explained with reference to FIG. 13.

Figure 13:
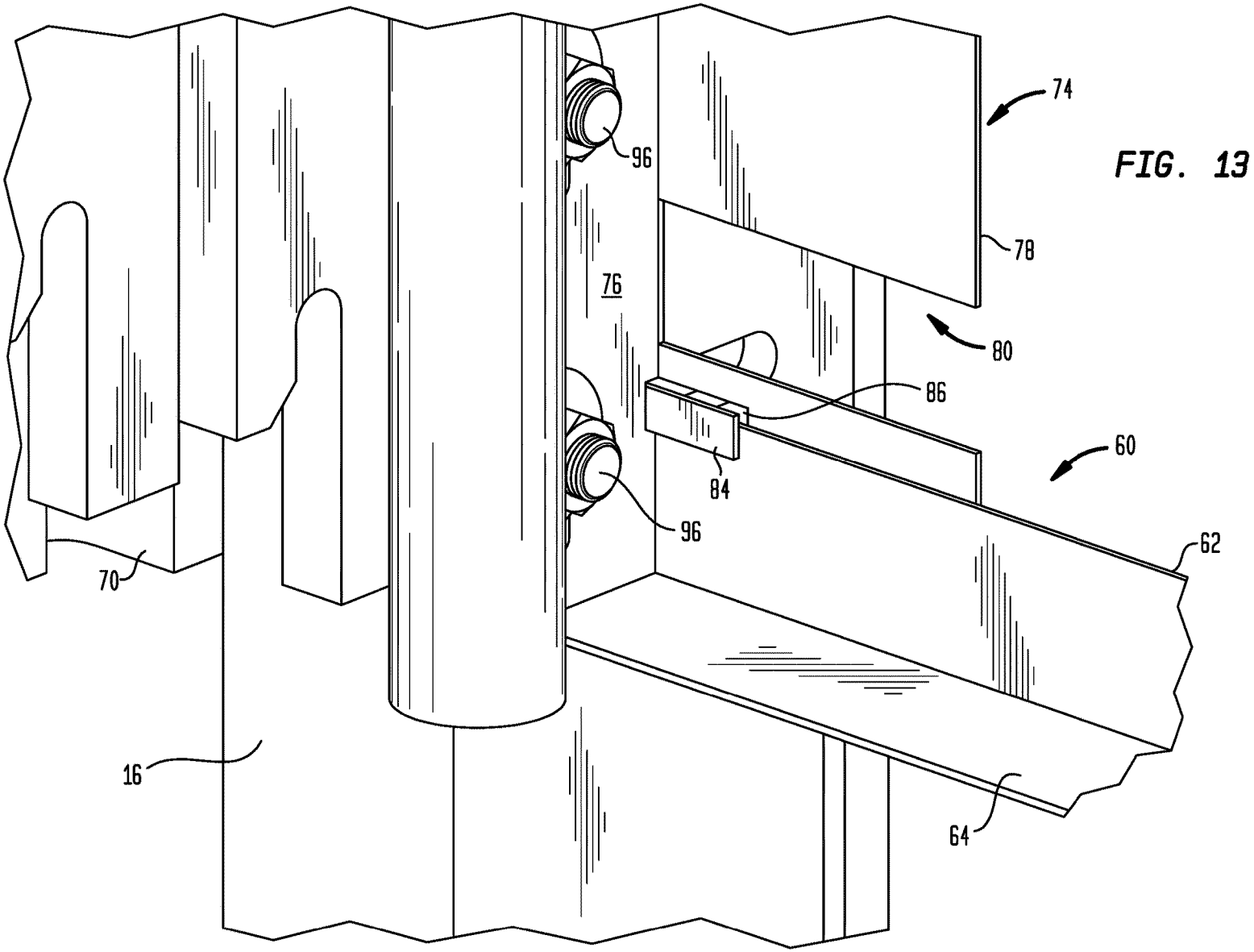

In FIG. 13, a part of an anchor attachment 70 is attached to a mullion 16, where part 70 is engaged with a second part 72 of the anchor attachment for attaching the slab to the mullion (see FIG. 11). Part 70 of the anchor attachment is attached to the mullion via fasteners 96, such as bolts and screws. In attaching the bracket 74 to the mullion 16, a method may use existing fasteners 96 that fasten the anchor attachment 70 to the mullion 16 to fasten the bracket. In a non-limiting example, an installation method may include loosening the fasteners 96 and sliding the side plate 76 of the bracket 74 into the anchor attachment so that the apertures (88 in FIG. 12) are engaged with the fasteners 96, such as bolts. This is further explained with reference to FIGS. 12 and 13. The opening of the aperture 88 is positioned to be aligned with a bolt 96 of the anchor attachment 70 to allow the side plate 76 to slip right into the anchor attachment without having to remove the anchor attachment 70 from the mullion 16. While the bolt 96 is slipped into the respective aperture 88 of the side plate 76, the aperture 88 engages with the bolt 96. Then, the method may include tightening the fasteners 96 to secure both the anchor attachment 70 and the side plate 76 of the bracket 74 to the mullion 16.

With further reference to FIG. 13, similar to bracket 30 described earlier in this document (e.g., in FIG. 10), a stiffener 60 may be an L-shaped bar, and the first receiving slot 84 of the back plate 78 may be positioned to receive a vertical face plate 62 of the stiffener 60. The flange of the back plate (94 in FIG. 12) may be positioned to support a horizontal face plate 64 of the L-shaped bar 60. In some embodiments, with reference to FIGS. 7 and 12, the stiffener 60 is a hat channel having a vertical face plate 62 positioned in the first receiving slot 84 of the back plate 78 of the bracket 74 and a horizontal face plate 64 extending inwardly from the vertical face plate further away from the front edge of the side plate of the bracket and positioned to rest on the top edge (102 in FIG. 12) of the back plate 78.

Returning to FIG. 12, bracket 74 may additionally have a top plate 95 extending perpendicularly from the side plate 76 and defining a second receiving slot 90 that is configured to receive a clip leg of a respective clip to engage the insulation. The clip is described earlier in this document (e.g., clip 50 in FIG. 3) and works the same way with the bracket 74 as it works with bracket 30.

Referring to FIGS. 1, 2 and 8-14, an example of a process for installing the spandrel insulation relative to a mullion and/or a transom may include: attaching two opposing brackets (e.g., 74 as described in FIG. 12) onto two opposing mullions, respectively, by engaging each bracket into an anchor attachment for each respective mullion, wherein the anchor attachment attaches the mullion to a floor slab. The process may also include installing the stiffener onto the two opposing brackets by sliding a vertical face plate of the stiffener into the second receiving slot of each of the two opposing brackets, which was described in the embodiments in FIG. 13. The process may also include positioning the insulation in a space defined between the two opposing mullions adjacent to the stiffener.

Figure 14:
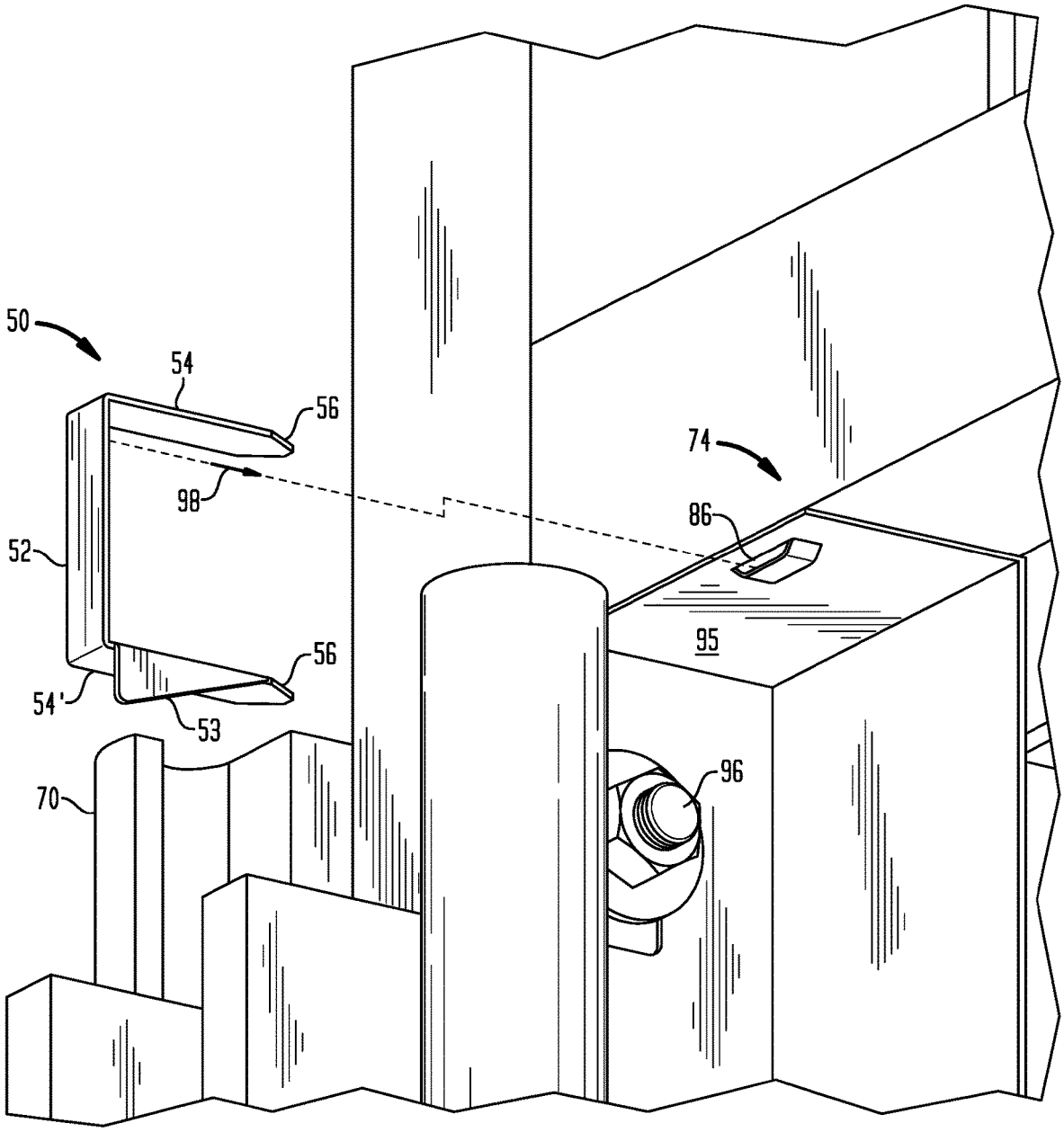

With reference to FIG. 14, the installation process may also include engaging the insulation by engaging each bracket with a clip having a pair of clip legs (e.g., a pair of clip legs described in the embodiments in FIG. 3). In a non-limiting example, the installation process may include: extending inwardly from a front edge of the side plate towards the back plate the first clip leg of the pair 54 through a second receiving slot 86 of the bracket 74 formed on a top plate 95 that extends perpendicularly from the side plate. This is shown in the direction 98. The process may also include penetrating the second clip legs of the pair 54' inwardly from a front side of the insulation towards the back plate of the bracket into the insulation (shown in direction 98).

The above-illustrated embodiments provide advantages over the existing systems. For example, the brackets can be attached to the mullion or transom quickly by a friction fit or a single screw without laborious installation as in installation of curtain wall in a conventional manner. Further, once the insulation is installed, the clips that engage with the bracket can be quickly inserted into the first receiving slot of the bracket with accuracy because the location of the receiving slot on the leg of the bracket can be determined from the mark on outside surface of the bracket, which is exposed. This allows for easy alignment of the clip.

Still further, the clip has both a tapered leg and a wing extending at a right angle from the tapered leg, so that when the clip is inserted into the spandrel insulation it allows the spandrel insulation to be retained inside the spandrel space without movement. Still further, the free end of the tapered leg of the clip is facing inward towards the spandrel insulation, thus, pushing the clips during installation creates no dangerous situation to the human installer as in other existing systems. Still further, the above-illustrated embodiments of the stiffener provide various ways to contend with floor slab attachment points for the curtain wall panels themselves that may be located at or near those points, which allows for proper installation. Still further, variations of the bracket are also shown above that may be attached to an anchor attachment that attaches the floor slab to the mullion so that the anchor attachment does not interfere with the bracket.

These and other advantages of the present invention will be apparent to those skilled in the art from the foregoing specification. For example, an insulation retaining system may concurrently include one or more variations of the bracket illustrated above that attach to various locations of the mullion/transom. In such a system, one or more brackets (e.g., configurations shown in FIG. 12) may be directly attached to the anchor attachment near the floor line, whereas one or more brackets (e.g., configurations shown in FIG. 3) may be attached to the mullion via friction. Each of the various brackets may be positioned to receive a clip to engage the insulation.

The features and functions described above, as well as alternatives, may be combined into many other different systems or applications as appreciated by one ordinarily skilled in the art. Accordingly, it will be recognized by those skilled in the art that changes or modifications may be made to the above-described embodiments without departing from the broad inventive concepts of the invention. It should, therefore, be understood that this invention is not limited to the particular embodiments described herein, but is intended to include all changes and modifications that are within the scope and spirit of the invention as defined in the claims.

What is claimed is:

1. A method of installing and retaining insulation relative to a mullion having a given width, the method comprising the steps of:

attaching two opposing brackets onto two opposing mullions, respectively, by engaging each bracket into an anchor attachment for each respective mullion, wherein the anchor attachment attaches the mullion to a slab, and each bracket comprises:

a side plate defining at least one aperture positioned to engage with a fastener of the anchor attachment for attaching the side plate to a side surface of the mullion, and a back plate extending perpendicularly from the side plate and defining a first receiving slot formed by a portion of the back plate that is cut and raised from a surface of the back plate, wherein the first receiving slot is configured to receive a face plate of a stiffener;

installing the stiffener onto the two opposing brackets by sliding a vertical face plate of the stiffener into the first receiving slot of each of the two opposing brackets; and positioning the insulation in a space defined between the two opposing mullions adjacent to the stiffener;

wherein the attaching comprises sliding the side plate of each bracket into the anchor attachment for the respective mullion so that the aperture of the side plate is engaged with a fastener of the anchor attachment.

2. The method of claim 1, further comprising:

engaging the insulation by engaging each bracket with a clip having a pair of clip legs by:

extending inwardly from a front edge of the side plate towards the back plate a first of the pair of clip legs through a second receiving slot of the bracket formed on a top plate that extends perpendicularly from the side plate; and penetrating a second of the pair of clip legs inwardly from a front side of the insulation towards the back plate of the bracket into the insulation.

3. The method of claim 2, wherein the second receiving slot is defined by a slot plate supported in spaced relation to a surface of the top plate, and engaging the bracket with the clip further comprises using an inwardly extending projection disposed on the clip to engage the slot plate once the clip leg has been extended through the second receiving slot.

4. The method of claim 2, further comprising using a tapered wing which extends outwardly from a second of the pair of clip legs and is wedged toward a tapered free end to help retain the insulation in the space defined between the two opposing mullions.

5. The method of claim 2, further comprising using a tapered free end of at least one of the pair of clip legs to facilitates passage into the second receiving slot.

6. The method of claim 2, further comprising using a tapered free end of at least one of the pair of clip legs to facilitate penetrating the insulation.

7. A method of installing and retaining insulation relative to a mullion having a given width, the method comprising the steps of:

attaching two opposing brackets onto two opposing mullions, respectively, by engaging each bracket into an anchor attachment for each respective mullion, wherein the anchor attachment attaches the mullion to a slab, and each bracket comprises:

a side plate defining at least one aperture positioned to engage with a fastener of the anchor attachment for attaching the side plate to a side surface of the mullion, and a back plate extending perpendicularly from the side plate and defining a first receiving slot formed by a portion of the back plate that is cut and raised from a surface of the back plate, wherein the first receiving slot is configured to receive a face plate of a stiffener;

installing the stiffener onto the two opposing brackets by sliding a vertical face plate of the stiffener into the first receiving slot of each of the two opposing brackets; and positioning the insulation in a space defined between the two opposing mullions adjacent to the stiffener;

wherein the stiffener is an L-shaped bar including a horizontal face plate, and the installing of the stiffener further comprises positioning the horizontal face plate so that it is supported on a flange which extends outwardly from a bottom of the back plate toward a front edge of the side plate.

8. A method of installing and retaining insulation relative to a mullion having a given width, the method comprising the steps of:

attaching two opposing brackets onto two opposing mullions, respectively, by engaging each bracket into an anchor attachment for each respective mullion, wherein the anchor attachment attaches the mullion to a slab, and each bracket comprises:

a side plate defining at least one aperture positioned to engage with a fastener of the anchor attachment for attaching the side plate to a side surface of the mullion, and a back plate extending perpendicularly from the side plate and having a first receiving slot disposed on a surface of the back plate, the first receiving slot defined by a slot plate and configured to receive a face plate of a stiffener;

installing the stiffener onto the two opposing brackets by sliding a vertical face plate of the stiffener into the first receiving slot of each of the two opposing brackets and causing the stiffener to be supported on a flange which extends outwardly from a bottom of the back plate toward a front edge of the side plate; and positioning the insulation in a space defined between the two opposing mullions adjacent to the stiffener.

9. A method of installing and retaining insulation relative to a mullion having a given width, the method comprising the steps of:

attaching two opposing brackets onto two opposing mullions, respectively, by engaging each bracket into an anchor attachment for each respective mullion, wherein the anchor attachment attaches the mullion to a slab, and each bracket comprises:

a side plate defining at least one aperture positioned to engage with a fastener of the anchor attachment for attaching the side plate to a side surface of the mullion, and a back plate extending perpendicularly from the side plate;

installing a stiffener onto the two opposing brackets by sliding a vertical face plate of the stiffener into a first receiving slot defined in each of the two opposing brackets; and positioning the insulation in a space defined between the two opposing mullions adjacent to the stiffener;

wherein the attaching comprises sliding the side plate of each bracket into the anchor attachment for the respective mullion so that the aperture of the side plate is engaged with a fastener of the anchor attachment.

10. The method of claim 9, further comprising:

engaging the insulation by engaging each bracket with a clip having a pair of clip legs by:

extending inwardly from a front edge of the side plate towards the back plate a first of the pair of clip legs through a second receiving slot of the bracket formed on a top plate that extends perpendicularly from the side plate; and penetrating a second of the pair of clip legs inwardly from a front side of the insulation towards the back plate of the bracket into the insulation.

11. The method of claim 10, wherein the second receiving slot is defined by a slot plate supported in spaced relation to a surface of the top plate, and engaging the bracket with the clip further comprises using an inwardly extending projection disposed on the clip to engage the slot plate once the clip leg has been extended through the second receiving slot.

12. The method of claim 10, further comprising using a tapered wing which extends outwardly from a second of the pair of clip legs and is wedged toward a tapered free end to help retain the insulation in the space defined between the two opposing mullions.

13. The method of claim 10, further comprising using a tapered free end of at least one of the pair of clip legs to facilitates passage into the second receiving slot.

14. The method of claim 10, further comprising using a tapered free end of at least one of the pair of clip legs to facilitate penetrating the insulation.

15. A method of installing and retaining insulation relative to a mullion having a given width, the method comprising the steps of:

attaching two opposing brackets onto two opposing mullions, respectively, by engaging each bracket into an anchor attachment for each respective mullion, wherein the anchor attachment attaches the mullion to a slab, and each bracket comprises:

a side plate defining at least one aperture positioned to engage with a fastener of the anchor attachment for attaching the side plate to a side surface of the mullion, and a back plate extending perpendicularly from the side plate;

installing a stiffener onto the two opposing brackets by sliding a vertical face plate of the stiffener into a first receiving slot defined in each of the two opposing brackets; and positioning the insulation in a space defined between the two opposing mullions adjacent to the stiffener;

wherein the stiffener is an L-shaped bar including a horizontal face plate, and the installing of the stiffener further comprises positioning the horizontal face plate so that it is supported on a flange which extends outwardly from a bottom of the back plate toward a front edge of the side plate.

* * * * *